US010843205B2

(12) United States Patent
Holopainen

(10) Patent No.: US 10,843,205 B2
(45) Date of Patent: Nov. 24, 2020

(54) METHOD FOR OPERATING A CRUSHER, A CRUSHING SYSTEM AND A CRUSHING PLANT

(71) Applicant: Metso Minerals, Inc., Helsinki (FI)

(72) Inventor: Pasi Holopainen, Tampere (FI)

(73) Assignee: METSO MINERALS, INC., Helsinki (FI)

( * ) Notice: Subject to any disclaimer, the term of this patent is extended or adjusted under 35 U.S.C. 154(b) by 971 days.

(21) Appl. No.: 14/893,684

(22) PCT Filed: May 26, 2014

(86) PCT No.: PCT/FI2014/050406

§ 371 (c)(1),
(2) Date: Nov. 24, 2015

(87) PCT Pub. No.: WO2014/191617

PCT Pub. Date: Dec. 4, 2014

(65) Prior Publication Data

US 2016/0107169 A1 Apr. 21, 2016

(30) Foreign Application Priority Data

May 28, 2013 (FI) ..... 20135576

(51) Int. Cl.
*B02C 25/00* (2006.01)
*B02C 2/00* (2006.01)
*B02C 23/04* (2006.01)

(52) U.S. Cl.
CPC ..... *B02C 25/00* (2013.01); *B02C 2/00* (2013.01); *B02C 23/04* (2013.01)

(58) Field of Classification Search
CPC ..... B02C 2/00–08; B02C 25/00; B02C 23/04
(Continued)

(56) References Cited

U.S. PATENT DOCUMENTS 3,328,888 A * 7/1967 Gieschen ..... B02C 2/04 33/701
3,804,342 A * 4/1974 Gasparac ..... B02C 2/045 241/37

(Continued)

FOREIGN PATENT DOCUMENTS

DE 202004006887 U1 8/2004
WO 2004/069415 A1 8/2004

(Continued)

OTHER PUBLICATIONS

PCT International Search Report and Written Opinion dated Mar. 10, 2015.
PCT IPRP dated Jul. 21, 2015.

*Primary Examiner* — Shelley M Self
*Assistant Examiner* — Smith Oberto Bapthelus
(74) *Attorney, Agent, or Firm* — Andrus Intellectual Property Law, LLP

(57) ABSTRACT

A method for operating a mineral material crusher, a system including a crusher, and a crushing plant. The mineral material crusher, includes a first crushing element and a second crushing element, defining a crusher gap therebetween. The crusher gap is maintained using at least one hydraulic cylinder, the hydraulic liquid pressure in at least one of the hydraulic cylinders is measured and hydraulic liquid is evacuated from the hydraulic cylinder when the hydraulic liquid pressure exceeds a set opening pressure limit. During the crushing process the following steps are repeated: generating, based on the hydraulic liquid pressure measurement, a representative value of a normal hydraulic liquid pressure in the at least one hydraulic cylinder caused by the crushable material in that crushing application; comparing the generated representative value and the set opening pressure limit; and selecting opening pressure limit
(Continued)

which is higher than the measured normal hydraulic liquid pressure.

9 Claims, 4 Drawing Sheets

(58) Field of Classification Search
USPC ..... 241/27–37, 207–216
See application file for complete search history.

(56) References Cited

U.S. PATENT DOCUMENTS 4,179,074 A * 12/1979 Flavel ..... B02C 25/00 241/24.1
4,187,991 A * 2/1980 Petrini Poli ..... B02C 2/047 241/33
4,251,035 A * 2/1981 Chatwin ..... B02C 2/047 241/207
5,500,088 A * 3/1996 Allison ..... B02C 7/14 162/198
10,357,777 B2 * 7/2019 Shumka ..... G01B 11/14
2004/0050983 A1 * 3/2004 Nieminen ..... B02C 2/00 241/101.3
2006/0231650 A1 * 10/2006 Nilsson ..... B02C 2/047 241/30
2006/0243833 A1 * 11/2006 Nilsson ..... B02C 1/025 241/30
2009/0256015 A1 * 10/2009 Torres ..... B02C 2/047 241/30
2010/0230519 A1 * 9/2010 Torres ..... B02C 2/047 241/25
2013/0001337 A1 * 1/2013 Sjoberg ..... B02C 23/04 241/27
2014/0166791 A1 * 6/2014 Tjell ..... B02C 1/02 241/30
2016/0107169 A1 * 4/2016 Holopainen ..... B02C 23/04 241/30

FOREIGN PATENT DOCUMENTS

WO 2005007293 A1 1/2005
WO 2008/010072 A2 1/2008
WO 2012/087219 A1 6/2012

* cited by examiner

METHOD FOR OPERATING A CRUSHER, A CRUSHING SYSTEM AND A CRUSHING PLANT

CROSS-REFERENCE TO RELATED APPLICATIONS

This application claims priority to PCT/FI2014/050406, filed May 26, 2014, and published in English on Dec. 4, 2014 as publication number WO 2014/191617, which claims priority to FI Application No. 20135576, filed May 28, 2013, incorporated herein by reference.

TECHNICAL FIELD

The invention relates to a method for operating a crusher, to a crushing system and a crushing plant. The invention relates particularly, though not exclusively, to protecting a mineral material crusher from uncrushable material.

BACKGROUND ART

Rock is gained from the earth for crushing by exploding or excavating. Rock can also be natural and gravel or construction waste. Mobile crushers and stationary crushing applications are used in crushing. An excavator or wheeled loader loads the material to be crushed into the crusher's feed hopper from where the material to be crushed may fall into the crusher or a feeder moves the rock material towards the crusher.

Mineral material is crushed in jaw crushers by moving a movable jaw relative to a fixed jaw. The movable and fixed jaws define therebetween a crushing chamber.

Mineral material is crushed in gyratory and cone crushers by moving an inner blade (crushing cone) relative to an outer blade. The inner and outer blades define therebetween a crushing chamber.

Mineral material is crushed in horizontal shaft impact crushers by rotating an inner horizontal shaft having impact beams relative to outer breaker plates. The shaft and the breaker plates define therebetween a crushing chamber.

Crushing capacity of a mineral material crusher is aimed to be used economically fully so that the crusher is loaded continuously with a high crushing power and simultaneously the used crushing power is directed for producing the planned product distribution. Interruptions in the crushing event (e.g. caused by overload) reduce efficiency.

Ending up of uncrushable or very hard material in a crushing chamber is disadvantageous. In such a case, an overload situation may arise in the crushing chamber and the mobile or stationary crushing plant, the crusher frame, and/or the crushing blade(s) may be damaged. In order to overcome the problem, the setting of the crusher has to be opened and the movable crushing blade has to be moved farther away from the fixed crushing blade. A concrete reinforcing bar is an example of adverse material which may end up in the crushing chamber when separating of material before the crushing is incomplete. Adverse is also material having unequal distribution and containing large pieces. Furthermore, the amount and location of the material in the crushing chamber affects the power intake of the crusher.

WO2012087219A1 shows a hydraulic circuit and a method for controlling a gyratory cone crusher. The crusher gap size is maintained by a hydraulic cylinder. In case the hydraulic liquid pressure exceeds a pressure threshold, hydraulic liquid is evacuated from the cylinder to increase the crusher gap size.

It is an object of the invention to provide an alternative way for controlling a gyratory or cone crusher during crushing. It is an object of the invention to provide a simple way for indicating the load present in a crushing chamber. It is an object of the invention to improve adjusting chances of the crushing event. It is an object of the invention to improve usability and efficiency of the crusher.

SUMMARY

According to a first example aspect of the invention there is provided a method for operating a mineral material crusher, wherein the crusher comprises a first crushing element and a second crushing element, defining a crusher gap therebetween, and the crusher gap is maintained using at least one hydraulic cylinder, and hydraulic liquid is evacuated from the at least one hydraulic cylinder in case the hydraulic liquid pressure in at least one of the hydraulic cylinders exceeds an opening pressure limit, the method comprising selecting an opening pressure limit which is higher than the normal hydraulic liquid pressure in the at least one hydraulic cylinder caused by the crushable material in that certain crushing application.

According to a second example aspect of the invention there is provided a method for operating a mineral material crusher, wherein the crusher comprises a first crushing element and a second crushing element, defining a crusher gap therebetween, and the crusher gap is maintained using at least one hydraulic cylinder, the hydraulic liquid pressure in at least one of the hydraulic cylinders is measured and hydraulic liquid is evacuated from the at least one hydraulic cylinder in case the hydraulic liquid pressure in at least one of the hydraulic cylinders exceeds a set opening pressure limit, and during the crushing process the following steps are repeated:

generating, based on the hydraulic liquid pressure measurement, a representative value of a normal hydraulic liquid pressure in the at least one hydraulic cylinder caused by the crushable material in that certain crushing application;

comparing the generated representative value and the set opening pressure limit; and selecting an opening pressure limit which is higher than the measured normal hydraulic liquid pressure.

Preferably the opening pressure limit is up to 100 bar higher than said normal hydraulic liquid pressure, Preferably in the method the opening pressure limit is 0 to 50 bar higher than said normal hydraulic liquid pressure.

Preferably adjusting the opening pressure limit of an adjustable pressure relief valve of the hydraulic cylinder.

Preferably measuring the pressure of the hydraulic liquid in the at least one hydraulic cylinder, wherein if the measured pressure exceeds the selected opening pressure limit an adjustable pressure relief valve of the at least one hydraulic cylinder is opened to contract the hydraulic cylinder; and if the measured pressure does not exceed the selected opening pressure limit the adjustable pressure relief valve is closed or maintained closed.

Preferably the operator inputs a suitable opening pressure limit by selecting the crushing application in question or selecting a pressure parameter manually.

Preferably the pressure of the hydraulic cylinder and/or the opening pressure limit is presented on a user interface to be observed by an operator.

According to a third example aspect of the invention there is provided a crushing system comprising a mineral material crusher, the crusher comprising a first crushing element and a second crushing element, defining a crusher gap therebetween, and at least one hydraulic cylinder arranged to maintain the crusher gap, the system being configured to evacuate hydraulic liquid from the at least one hydraulic cylinder in case the hydraulic liquid pressure in at least one of the hydraulic cylinders exceeds an opening pressure limit, wherein the system comprises a pressure sensor configured to measure the normal hydraulic liquid pressure in the at least one hydraulic cylinder caused by the crushable material in that certain crushing application; a control unit configured to receive an opening pressure limit which is higher than said normal hydraulic liquid pressure.

According to a fourth example aspect of the invention there is provided a crushing system comprising a mineral material crusher, the crusher comprising a first crushing element and a second crushing element, defining a crusher gap therebetween, and at least one hydraulic cylinder arranged to maintain the crusher gap, the system comprising a pressure sensor configured to measure the normal hydraulic liquid pressure in the at least one hydraulic cylinder caused by the crushable material in that certain crushing application, the system being configured to evacuate hydraulic liquid from the at least one hydraulic cylinder in case the hydraulic liquid pressure in at least one of the hydraulic cylinders exceeds a set opening pressure limit, and the system comprises a control unit configured to receive an opening pressure limit which is higher than the measured normal hydraulic liquid pressure, the opening pressure limit being determined according to the method of according to the first or second example aspect of the invention.

Preferably the opening pressure limit is up to 100 bar higher than said normal hydraulic liquid pressure.

Preferably the control unit is configured to compare the measured hydraulic liquid pressure of the at least one hydraulic cylinder with the opening pressure limit, and if the measured pressure exceeds said opening pressure limit an adjustable pressure relief valve is configured to open to contract the hydraulic cylinder; and if the measured pressure does not exceed the selected opening pressure limit the adjustable pressure relief valve is configured to close or maintain closed.

Preferably the system comprises a user interface on which the measured pressure and/or said opening pressure limit is presented.

The energy efficiency of the crusher can be increased by such control of the pressure relief device which detects the crushing forces relating to the material to be crushed and further lowers the opening force of the pressure relief device. Productivity of the crusher can thereby be improved. Further, peak loads in the crusher decrease, and lifetime of the crusher and the wear parts thereof can be prolonged by a suitable control of the relief device.

Preferably the system is configured to adjust the hydraulic liquid pressure in the at least one hydraulic cylinder during crushing so that the size of the crusher gap is increased at a pressure measurement which corresponds to a load exceeding the pressure limit.

Preferably the system comprises at least one measuring apparatus suitable for measuring the crusher load, a control unit suitable for determining the level of the crusher load, and adjusting valves of the hydraulic cylinders to adjust the crusher gap based on detections of the system.

Further, the system may comprise a user interface connected to the control unit. Preferably the user interface is configured to receive opening pressure limit selections of the operator.

Additionally, the system may be arranged to adjust the rotational speed of the crusher drive.

According to a third aspect of the invention there is provided a crushing plant which comprises a crushing system according to an embodiment of this invention. Energy efficiency of the plant can be improved.

Preferably the crusher is a jaw crusher, a gyratory crusher, a cone crusher, or a horizontal shaft impact crusher.

Different embodiments of the present invention will be illustrated or have been illustrated only in connection with some aspects of the invention. A skilled person appreciates that any embodiment of an aspect of the invention may apply to the same aspect of the invention and other aspects alone or in combination with other embodiments as well.

BRIEF DESCRIPTION OF THE DRAWINGS

The invention will be described, by way of example, with reference to the accompanying drawings, in which.

DETAILED DESCRIPTION

In the following description, like numbers denote like elements. It should be appreciated that the illustrated drawings are not entirely in scale, and that the drawings mainly serve the purpose of illustrating embodiments of the invention.

Figure 1:
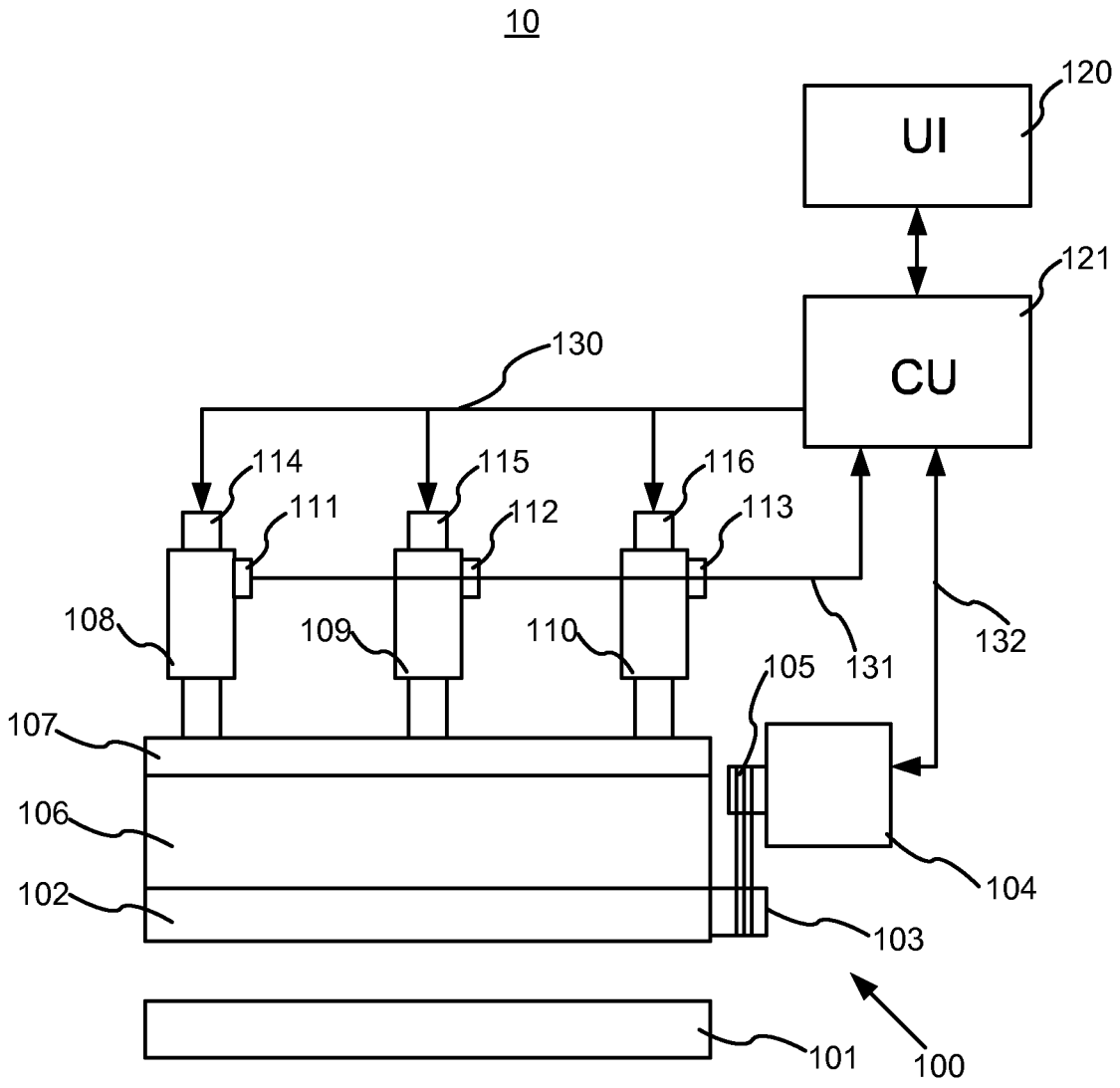
FIG. 1 shows schematically a crushing system according to a preferred embodiment of the invention in connection with a jaw crusher.
Figure 4A:
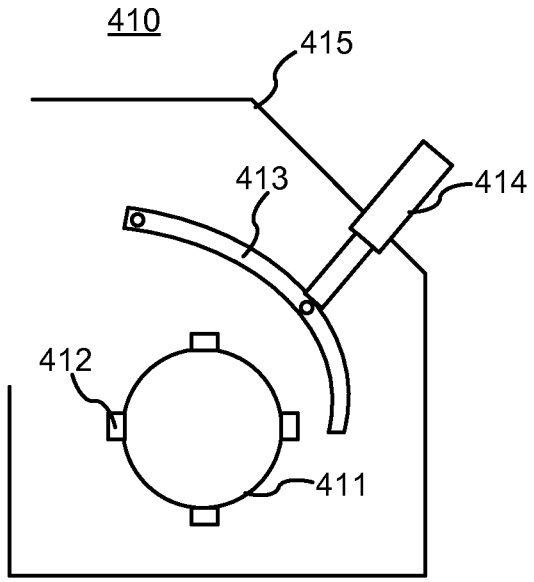
FIG. 4*a* shows a side view of a horizontal shaft impact crusher.
Figure 4B:
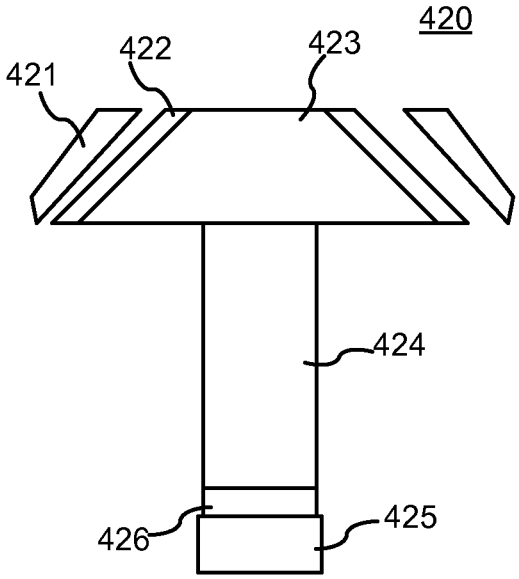
FIG. 4*b* shows a side view of a cone or gyratory crusher.

The crushing system 10 described hereinbefore alongside FIGS. 1, 4*a* and 4*b* is implemented in connection with a mineral material crusher having an adjustable crusher gap such as a jaw crusher 100, an impact crusher 410, and a cone or gyratory crusher 420.

In FIGS. 1, 4*a* and 4*b*, the load of the crusher is measured indirectly by a measuring apparatus which measures the hydraulic liquid pressure of one or more hydraulic cylinders maintaining the crusher gap, and eventually the power of a crusher drive.

FIG. 1 shows a crushing system 10 implemented in connection with a jaw crusher 100. The jaw crusher comprises a fixed jaw 101 as a first crushing element and a movable jaw 102 as a second crushing element. The movable jaw 102 and the fixed jaw 101 define a crusher gap therebetween.

The movable jaw 102 is supported to a body of the crusher (not shown in the Figure) and moved by an eccentric shaft 103 (main shaft). The eccentric shaft is rotated by a crusher drive 104 via a transmission 105. The crusher drive 104 may be an electric or a hydraulic motor. The transmission 105 may comprise for example a flywheel and a belt pulley on the eccentric shaft, belts, and a belt pulley on the crusher drive shaft. The movable jaw is also supported by a toggle plate 106 in contact with the jaw, hydraulic cylinders 108, 109,110 fixed to the body of the crusher, and a support structure 107 between the toggle plate and the hydraulic cylinders.

The hydraulic cylinders 108,109,110 are operated to maintain the crusher gap size during crushing, i.e. the setting of the crusher is adjusted by the hydraulic cylinders. Each hydraulic cylinder 108,109,110 comprises as a measuring apparatus a hydraulic pressure sensor 111,112,113 by which the load of the crusher 100 can be measured. The load of the crusher 100 can also be measured by a measuring apparatus measuring the power of the crusher drive 104, or both the hydraulic pressure and the crusher drive power.

The normal load (the normal hydraulic liquid pressure) caused by the crushable material in a certain crushing application can be measured in a known way. The measurements of the hydraulic pressure sensors 111,112,113 by which the normal load of the crusher is measured can firstly be averaged, for example a period of time of 1 or 0.5 seconds; or a period of one, two, three, four or more crusher main axis revolutions. Secondly, the normal hydraulic liquid pressure can be determined of peak load measurements, for example from a first detected peak load or from 2 to 4 detected peak loads caused by the material which is crushed in that certain crushing application.

Each hydraulic cylinder 108,109,110 comprises an adjustable pressure valve 114,115,116. The adjustable pressure valves 114,115,116 operate as hydraulic pressure relief devices and are arranged to evacuate hydraulic liquid from the hydraulic cylinders in case the hydraulic liquid pressure exceeds a pressure limit measured by at least one of the hydraulic pressure sensors 111,112,113.

A control unit CU 121 receives pressure measuring signals corresponding to the crusher load from the hydraulic pressure sensors 111,112,113 via first connections 131. The control unit CU 121 among others can determine the level of the crusher load from the received measuring signals and react correspondingly. If necessary, the control unit CU 121 sends via second connections 130 control signals to the adjustable pressure valves 114,115,116. Thereby the hydraulic cylinders 108,109,110 are feedback controlled through the first and second connections 131-130.

Preferably the system 10 detects the hydraulic liquid pressure (320,330, FIGS. 3*c*,3*d*) on each crushing revolution of the main axis 103,411,424 of the crusher 100,410,420.

Further, the feedback controlled system 10 comprises a user interface UI 120 connected to the control unit 121.

Additionally, the control unit CU 121 may receive measuring signals from the crusher drive 104 and, if desired, sends optionally back control signals to the crusher drive 104, via a third connection 132 (for example to adjust the rotational speed or torsional moment of the crusher drive) in response to exceeding of measured hydraulic cylinder pressure $P_M$ of a set opening pressure limit $P_{Th}$ as described hereinafter.

The invention is described hereinbefore referring to three hydraulic cylinders to maintain the crusher gap size during crushing with a corresponding number of adjustable pressure valves and hydraulic pressure sensors. The number of hydraulic cylinders supporting the toggle plate may also be different from three, for example one, two, four, five, six or more and the number is not intended in any way to be invention limiting. According to an embodiment the crushing system comprises one hydraulic cylinder with a hydraulic pressure sensor to measure the hydraulic liquid pressure $P_M$ in the one hydraulic cylinder caused by the crushable material.

Figure 2A:
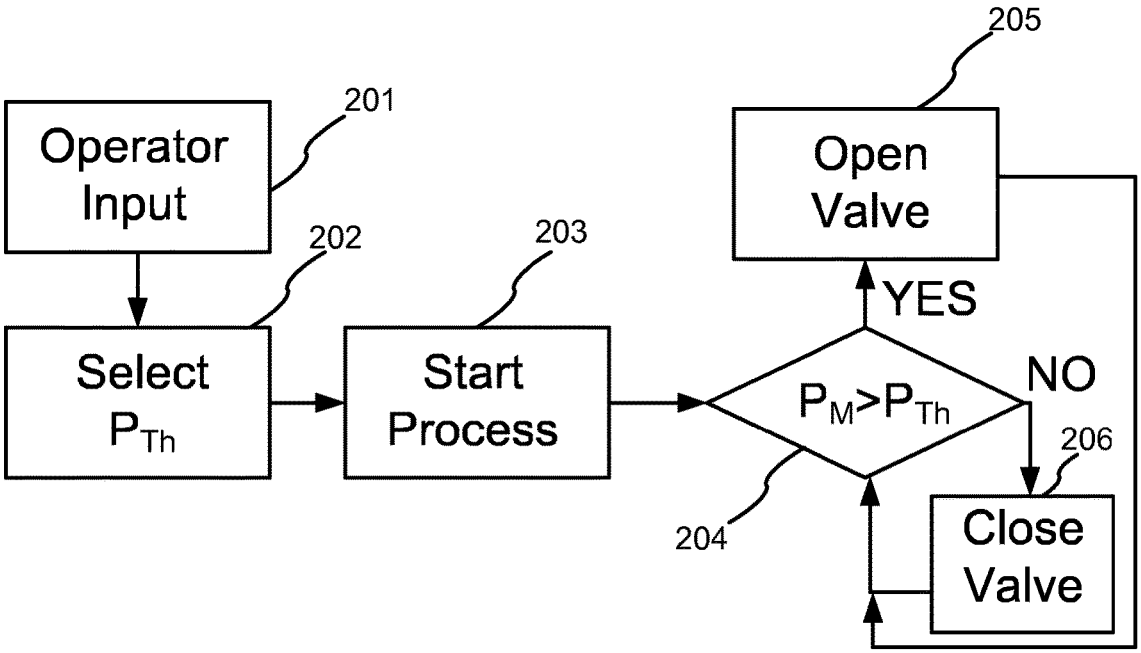
FIG. 2*a* shows a flow chart of a method according to a preferred embodiment of the invention.
Figure 2B:
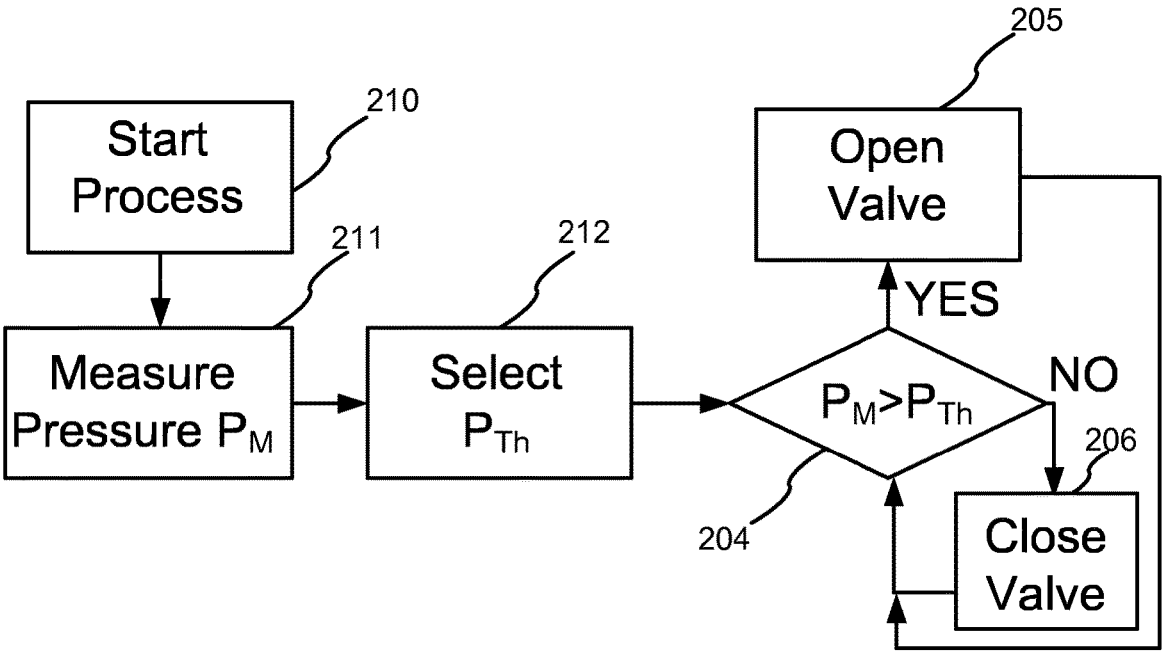
FIG. 2*b* shows a flow chart of a method according to another preferred embodiment of the invention.

FIGS. 2*a* and 2*b* show flow charts of two methods according to preferred embodiments of the invention.

In step 201 of the method shown in FIG. 2*a* the operator inputs a suitable hydraulic cylinder 108,109,110,414,425 opening pressure limit $P_{Th}$ by selecting 202 the crushing application in question or selecting 202 a pressure parameter manually. The operator input is preferably made using the user interface 120 of the crushing system 10, for example by selecting from a group of predetermined crushing applications, or by setting a pressure limit parameter or value. It may to a certain extent be known to the operator which opening pressure limit is representing demands of a particular crushing application. That initial opening pressure limit serves at least as a promising springboard for starting the crushing process.

The crushing system 10 may later determine independently and automatically what kind of adjustment the opening pressure limit will need. The opening pressure limit is preferably adjusted for a small load so that in case of uncrushable material the system may directly increase the setting. The automatic adjustment (automatic selecting or setting) of the opening pressure limit can follow the starting phase during repeating measurement 211 and comparison 204 phases of the system 10 (not shown in the Figures).

After the selecting step 202 the operator starts in step 203 the crushing process for example using the user interface 120.

According to an example embodiment, if the pressure $P_M$ measured by a pressure sensor 111,112,113 at a hydraulic cylinder 108,109,110 exceeds the set opening pressure limit $P_{Th}$ in the comparison of the step 204, the control unit 121 controls that the pressure valves 114,115,116 open in step 205 in response to the exceeding of the set opening pressure limit. The hydraulic cylinder 108,109,110,414,425 contracts and thereby preferably the setting can be opened actively or passively.

The passive opening of the setting means that the crushing force from the crushing chamber pushes the hydraulic cylinder so that the crusher gap is widened. The active opening of the setting means that the hydraulic cylinder is adjusted automatically to contract after opening the pressure valve 114,115,116, so that the crusher gap is widened preferably quicker than in the passive opening.

The setting is opened such that uncrushable material passes through the crusher gap. After it is detected that there is no uncrushable material in the crushing chamber the setting is returned to the previous crushing situation where the exceeding of the opening pressure limit was not detected.

The comparison step 204 is repeated throughout the duration of the crushing process. If the pressures $P_M$ measured by the pressure sensors 111,112,113 at the hydraulic cylinders 108,109,110 do not exceed the set opening pressure limit $P_{Th}$ in the comparison of the step 204, the control unit 121 controls that the pressure valve 114,115,116 is closed or is maintained closed in step 206. When the uncrushable material is detected the pressure valve 114,115, 116 opens.

In the method shown in FIG. 2*b* the operator starts the crushing process in step 210 for example using the user interface 120. In step 211, the pressure $P_M$ is measured a predetermined time by a pressure sensor 111,112,113 at a hydraulic cylinder 108,109,110. In step 212, an average value or a corresponding representative value is generated based on the measurements of step 211 for example in the control unit 121. Further in step 212, an opening pressure limit $P_{Th}$ for the pressure valve 114-116 is selected on the basis of the generated representative value. The remaining part of the method of FIG. 2*b* with the further steps 204,205, 206 are the same as in the method of FIG. 2*a*.

Figure 3A:
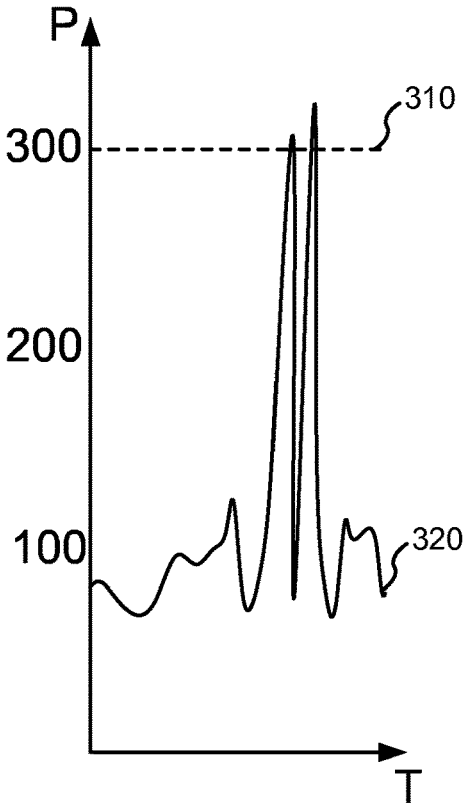
FIGS. 3*a* and 3*b* show presentations of a prior art fixed pressure limit in two applications.
Figure 3B:
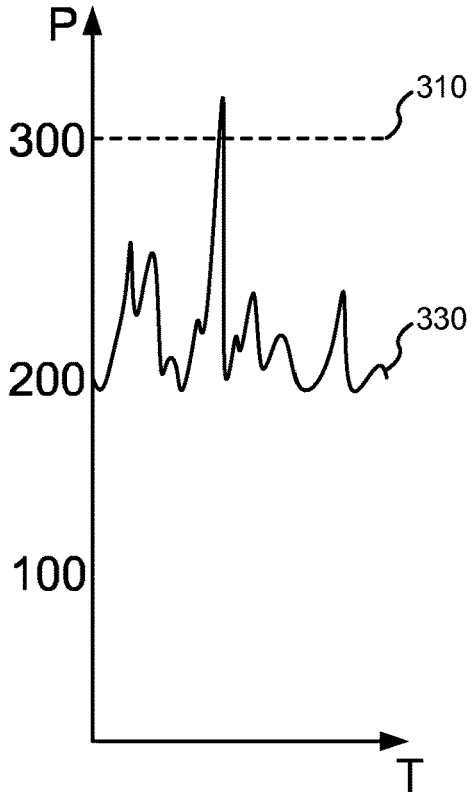
Figure 3C:
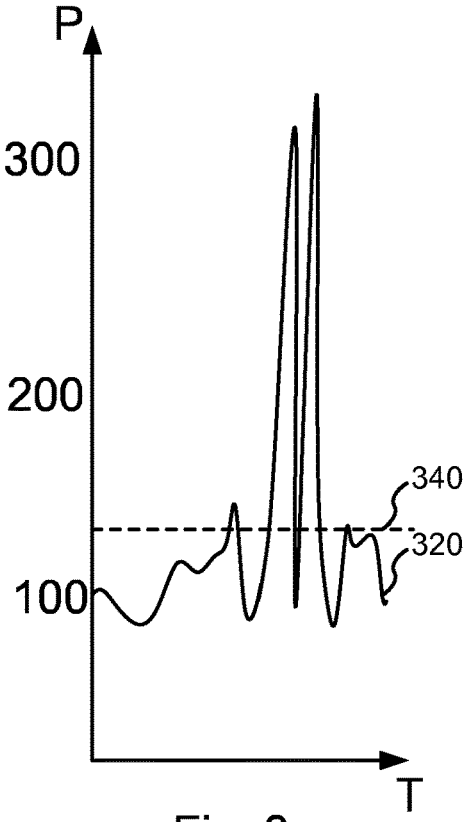
FIGS. 3*c* and 3*d* show presentations of an adjustable pressure limit according to a preferred embodiment of the invention.
Figure 3D:
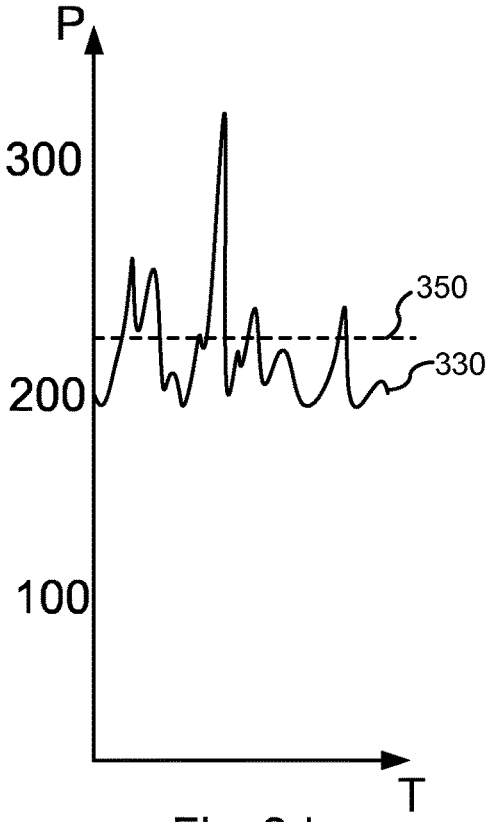

In the methods shown in FIGS. 2*a* and 2*b*, the selected opening pressure limit $P_{Th}$ is advantageously set to represent that hydraulic liquid pressure P in the hydraulic cylinders which is corresponding to the typically normal load of the crushable material in a certain crushing application as shown in FIGS. 3*c* and 3*d*.

Thus, the method of the invention is improved compared to prior art in that the selected opening pressure limit $P_{Th}$ of the invention is not intended to represent or very rarely represents a peak load caused by uncrushable material as shown in FIGS. 3*a* and 3*b*.

The crushing applications may vary for instance from soft to hard crushable material, or the application may be determined by a name of a mineral, quarry, batch, construction waste, asphalt, bricks, construction iron comprised in the material to be crushed etc. corresponding to certain pressure limit values.

The normal load (including eventually also the highest measured load or typically high load) in a certain crushing application may be set manually by the operator (FIG. 2*a*) or the load can be measured and determined automatically by the crushing system 10 at the initial phase of the crushing process (FIG. 2*b*). Alternatively or additionally to the manual setting of a predetermined limit and/or automatic determining of the opening pressure limit $P_{Th}$ in the initial phase, the limit may be determined during and throughout the duration of the crushing process, for example if the properties of the crushable material change or a batch is inhomogeneous.

According to a preferable embodiment of the method, the operator sets manually 202 an initial opening pressure limit $P_{Th}$, then starts the process 203 after which the steps 204, 205, 206 are repeated by the system 10, until for example the process is interrupted by the operator. Simultaneously with the steps 204, 205, 206 also the steps 211 and 212 are repeated by the system 10 (for example at predetermined intervals) for determining the opening pressure limit $P_{Th}$ during the crushing process so that the adjusted opening pressure limit $P_{Th}$, adjusted by the crushing system 10, is in use after initial phase of the crushing process. The system 10 may adjust the opening pressure limit $P_{Th}$ independently of the operator also in such a situation where pressure properties of the material to be crushed vary during the process.

FIGS. 3*a* and 3*b* show presentations of pressure curves and a prior art fixed opening pressure limit in two applications. The time T is shown on the horizontal axis and the pressure P is shown on the vertical axis.

A prior art opening pressure limit 310 works as a fixed setting (for example 300 bar) for a pressure valve. An example pressure curve 320 of application 1, e.g. construction waste (concrete & iron) is shown in FIG. 3*a* where two load peaks caused by construction iron are detected exceeding the fixed pressure limit 310. An example pressure curve 330 of application 2, e.g. hard stone in a quarry is shown in FIG. 3*b* where one load peak is detected exceeding the fixed pressure limit 310. Both prior art pressure curves represent a situation where the pressure valve is opened at pressure 300 bar for increasing the setting of the crusher.

FIGS. 3*c* and 3*d* show presentations of adjustable opening pressure limits 340 and 350 according to a preferred embodiment of the invention.

In the application 1 a typical and normal crushing pressure 320 in the hydraulic cylinders is about 110 and below 150 bar. If there exist lower pressure (peaks) than the adjusted opening pressure limit 340 ($P_{Th}$), 135 bar, the pressure in the hydraulic cylinders maintaining the crusher gap is not lowered and the gap is not opened.

In the application 2 the typical crushing pressure 330 in the hydraulic cylinders is about 220 bar and below 260 bar. If there exist lower pressure peaks than the adjusted opening pressure limit 350 ($P_{Th}$), 230 bar, the pressure in the hydraulic cylinders maintaining the crusher gap is not lowered and the gap is not opened.

The inventor has invented that the pressure relief valve 114-116 of the hydraulic cylinder 108,109,110,414,425 can be adjusted in accordance with the properties of the material to be crushed so that the energy used for the crushing attempt can be minimized. In applications 1 and 2, valuable crushing work is done mainly at the normal crushing pressure range of a particular application. Lifetime of the crusher and components thereof can be prolonged. Fatigue and general wear in the crusher can be decreased due to lowering of the peak loads in the crushing process.

According to a preferred embodiment of the method the opening pressure limit $P_{Th}$ is set up to 50 bar higher, more preferably up to 30 bar higher, still more preferably up to 10 bar higher than the normal crushing pressure caused by a particular material to be crushed.

According to a preferable embodiment of the method, when the normal crushing pressure is 0 to 50 bar, the opening pressure limit of the pressure relief valve is adjusted 60 bar. If in that application a pressure peak were 200 bar (for example a load peak caused by a hard stone), superfluous work is not done in pressures exceeding 60 bar.

A proportionally adjustable pressure relief valve may be used as the pressure valve 114-116. The normal crushing pressure corresponding to the crushed material in a particular crushing application is measured by the pressure sensors 111,112,113. A pressure sensor may also be coupled common for several hydraulic cylinders. Using the measured pressure $P_M$ the operator and/or the system can determine if the adjustable opening pressure limit $P_{Th}$ should be adjusted.

The adjustable opening pressure limit invention improves the prior art situation where lower pressure peaks than 300 bar do not lead to lowering of the pressure in the hydraulic cylinders maintaining the crusher gap and the gap is not opened.

Thus, the prior art crushing method works up to 300 bar pressure also with uncrushable material or material causing higher hydraulic cylinder pressure than desired for crushing the material fed into the process of the application in question, and energy is wasted. In the application 1 superfluous crushing work is done at least between 130 and 300 bars, i.e. a gap of about 170 bars. In the application 2 superfluous crushing work is done at least between 260 and 300 bars, i.e. a gap of about 40 bars.

The method allows the crusher main axis to rotate without stopping because a pressure peak exceeding the set pressure limit is not received entirely by the crusher, not even when the first pressure peak appears.

FIG. 4*a* shows a horizontal shaft impact crusher 410 (HSI crusher). The crushing system 10 described in connection with FIG. 1 may as well be implemented in connection with the HSI crusher 410. The HSI crusher comprises a rotatable horizontal shaft 411 (main shaft) comprising impact beams 412 as the first crushing element and a movable breaker plate 413 as the second crushing element. The breaker plate 413 and the horizontal shaft 411 define a crusher gap therebetween.

The horizontal shaft 411 is supported to a body 415 of the crusher and rotated by a crusher drive (not shown in the Figure). The crusher drive may be an electric or a hydraulic motor. The breaker plate 413 is pivotably supported by the body 415. The breaker plate 413 is also supported by hydraulic cylinder(s) 414 (corresponding to the hydraulic cylinders 108,109,110 of the crushing system 10) fixed to the body of the crusher.

The at least one hydraulic cylinder 414 is operated to maintain the crusher gap size during crushing, i.e. the setting of the crusher is adjusted by the hydraulic cylinders. Each hydraulic cylinder 414 comprises as a measuring apparatus a hydraulic pressure sensor by which the load of the crusher 410 can be measured.

Each hydraulic cylinder 414 comprises an adjustable pressure valve operating as a hydraulic pressure relief device and is arranged to evacuate hydraulic liquid from the hydraulic cylinder in case the hydraulic liquid pressure exceeds a pressure limit measured by at least one of the hydraulic pressure sensors. The rest of the crushing system 10 is described in FIG. 1.

FIG. 4*b* shows a cone or gyratory crusher 420. The crushing system 10 described in connection with FIG. 1 may as well be implemented in connection with the cone or gyratory crusher 420. The cone or gyratory crusher 420 comprises an outer fixed wear part 421 as the first crushing element, and a gyrating inner wear part 422 (also called mantle) as the second crushing element. The inner wear part is fixed on a head 423 which is fixed on a gyrating shaft 424 (main shaft). The inner wear part 422 and the outer wear part 421 define a crusher gap therebetween.

The shaft 424 is supported to a body of the crusher and rotated by a crusher drive (not shown in the Figure). The crusher drive may be an electric or a hydraulic motor. In a certain type of cone crushers, the shaft 424 is vertically supported by a hydraulic cylinder 425 (corresponding to the hydraulic cylinders 108,109,110 of the crushing system 10) below the shaft 424 and fixed to the body of the crusher. The hydraulic cylinder 425 is operated to maintain the crusher gap size during crushing, i.e. the setting of the crusher is adjusted by the hydraulic cylinder. A thrust bearing 426 is located below the shaft 424 and on the hydraulic cylinder 425 for allowing the gyratory movement of the shaft 424.

In a certain type of gyratory crushers, the shaft 424 is supported gyratory to the body of the crusher, and the hydraulic cylinders (corresponding to the hydraulic cylinders 108,109,110 of the crushing system 10) responsive for the crusher gap (setting) adjusting are located around the outer wear part in an adjustable upper body of the crusher.

The hydraulic cylinder 425 comprises as a measuring apparatus a hydraulic pressure sensor by which the load of the crusher 420 can be measured.

The hydraulic cylinder 425 comprises an adjustable pressure valve operating as a hydraulic pressure relief device and is arranged to evacuate hydraulic liquid from the hydraulic cylinder in case the hydraulic liquid pressure exceeds a pressure limit measured by at least one of the hydraulic pressure sensors. The rest of the crushing system 10 is described in FIG. 1.

Figure 5:
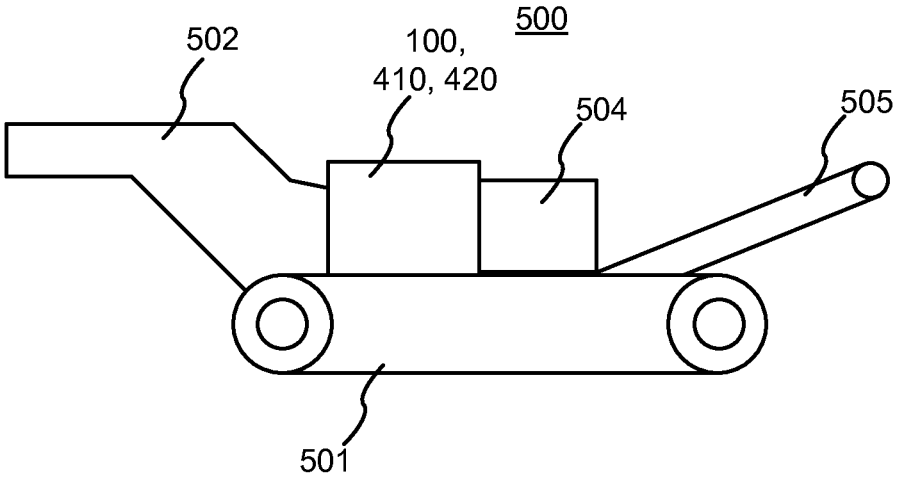
FIG. 5 shows a side view of a mineral material processing plant comprising a crusher.

FIG. 5 shows a track-mounted mobile crushing plant 500 which comprises a body, a track base 501, a feeder 502 and a crusher 100,410,420 with the crushing system 10 described hereinbefore. The crushing plant 500 further comprises a motor unit 504 for driving and controlling the crusher and a discharge conveyor 505 for conveying crushed material for example to a pile. The crusher can be used for example as an intermediate or after crusher. The mobile crushing plant may be movable or portable also by other means such as by wheels, skids or legs. The crushing station may also be stationary.

The detected higher pressure may be caused by uncrushable material ending up in the crushing chamber. The detected higher pressure enables reacting to the ending up of uncrushable material into the crushing chamber already before a load or pressure peak overriding safety limits would cause measures. Preferably the reaction can be initiated already from the first pressure peak.

Without in any way limiting the scope, interpretation or possible applications of the invention, reducing of the energy consumption and the noise production can be considered technical advantages of different embodiments of the invention. Further, prolonging the lifetime of components of the mineral material crusher and processing plant can be considered a technical advantage of different embodiments of the invention. Long lasting heavy loads are no longer directed to the structures of the crusher and the frame of the crushing plant. Further, increasing the environmental friendliness of the mineral material crusher and processing plant can be considered a technical advantage of different embodiments of the invention. Further, improving the safety of the mineral material crusher and processing plant can be considered a technical advantage of different embodiments of the invention. Further, increasing the effective operating hours of the mineral material crusher and processing plant can be considered a technical advantage of different embodiments of the invention.

The foregoing description provides non-limiting examples of some embodiments of the invention. It is clear to a person skilled in the art that the invention is not restricted to details presented, but that the invention can be implemented in other equivalent ways. Some of the features of the above-disclosed embodiments may be used to advantage without the use of other features.

As such, the foregoing description shall be considered as merely illustrative of the principles of the invention, and not in limitation thereof. Hence, the scope of the invention is only restricted by the appended patent claims.

The invention claimed is:

1. A method for operating a mineral material crusher during a crushing process, wherein the crusher comprises a first crushing element and a second crushing element, defining a crusher gap therebetween, the method comprising repeatedly performing during crushing process:

maintaining the crusher gap using at least one hydraulic cylinder during the crushing process;

measuring a hydraulic liquid pressure in at least one of the hydraulic cylinders during the crushing process;

generating a representative value of the hydraulic liquid pressure in the at least one hydraulic cylinder caused by crushable material during a certain crushing application based on one of an average and one or more peaks of the hydraulic liquid pressure measured in the at least one hydraulic cylinder;

setting a set opening pressure limit that is higher than the representative value of the hydraulic liquid pressure generated by a determined amount; and evacuating hydraulic liquid from the at least one hydraulic cylinder to increase the crusher gap when the measured hydraulic liquid pressure in any of the at least one hydraulic cylinder exceeds the set opening pressure limit.

2. The method of claim 1, further comprising setting the set opening pressure limit up to 100 bar higher than the representative value of the hydraulic liquid pressure.

3. The method of claim 1, further comprising adjusting the set opening pressure limit of an adjustable pressure relief valve of the at least one hydraulic cylinder.

4. The method of claim 1, wherein the at least one hydraulic cylinder comprises an adjustable pressure relief valve, the method further comprising:

opening the adjustable pressure relief valve of the at least one hydraulic cylinder to contract the at least one hydraulic cylinder when the hydraulic liquid pressure measured exceeds the set opening pressure limit; and closing or maintaining closed the adjustable pressure relief valve when the hydraulic liquid pressure measured does not exceed the set opening pressure limit.

5. The method of claim 1, further comprising presenting on a user interface at least one of the hydraulic liquid pressure measured in the at least one hydraulic cylinder and the set opening pressure limit.

6. A crushing system operable to repeatedly perform a crushing process, the crushing system comprising:

a mineral material crusher comprising a first crushing element and a second crushing element, wherein the first crushing element and the second crushing element define a crusher gap therebetween;

at least one hydraulic cylinder arranged and operable to maintain the crusher gap during the crushing process;

a pressure sensor configured to measure the hydraulic liquid pressure in the at least one hydraulic cylinder caused by the crushable material during the crushing process; and a control unit configured to maintain the crusher gap during the crushing process by;

receiving a pressure measurement from the pressure sensor indicating the measured hydraulic liquid pressure in the at least one of the hydraulic cylinder during the crushing process;

generating a representative value of the hydraulic liquid pressure in the at least one hydraulic cylinder caused by crushable material during a certain crushing application based on one of an average and one or more peaks of the hydraulic liquid pressure measured in the at least one hydraulic cylinder;

setting a set opening pressure limit that is higher than the representative value of the hydraulic liquid pressure generated by a determined amount; and evacuating hydraulic liquid from the at least one hydraulic cylinder to increase the crusher gap when the measured hydraulic liquid pressure in any of the at least one hydraulic cylinder exceeds the set opening pressure limit.

7. The crushing system of claim 6, wherein the set opening pressure limit is up to 100 bar higher than the representative value of the hydraulic liquid pressure.

8. The crushing system of claim 6, further comprising an adjustable pressure relief valve that is configured:

to open to contract the at least one hydraulic cylinder when the hydraulic liquid pressure measured exceeds the set opening pressure limit; and to close or maintain closed the at least one hydraulic cylinder when the hydraulic liquid pressure measured does not exceed the set opening pressure limit.

9. The crushing system of claim 6, further comprising a user interface configured to present at least one of the hydraulic liquid pressure measured and the set opening pressure limit.

* * * * *